US006224692B1

(12) United States Patent
Cantacuzene

(10) Patent No.: US 6,224,692 B1
(45) Date of Patent: May 1, 2001

(54) PROCESS FOR GALVANIZING A METAL STRIP

(75) Inventor: Serban Cantacuzene, Massy (FR)

(73) Assignee: L'Air Liquide Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/369,183

(22) Filed: Aug. 6, 1999

(30) Foreign Application Priority Data

Aug. 13, 1998 (FR) ..... 98 10392

(51) Int. Cl.[7] ..... B05D 1/18

(52) U.S. Cl. ..... 148/533; 427/321; 427/432; 427/433

(58) Field of Search ..... 148/533; 427/321, 427/432, 433

(56) References Cited

U.S. PATENT DOCUMENTS

| | | | | |
|---|---|---|---|---|
| 4,053,663 | | 10/1977 | Caldwell et al. | 427/320 |
| 4,107,357 | | 8/1978 | Asakawa et al. | 427/300 |
| 4,123,292 | * | 10/1978 | Gibson et al. | 427/321 |
| 4,557,953 | | 12/1985 | Boston et al. | 427/432 |

FOREIGN PATENT DOCUMENTS 2 082 206 3/1982 (GB) .

OTHER PUBLICATIONS

Patent Abstracts of Japan, vol. 18, No. 114 (C–1171), Feb. 24, 1994 & JP 05 306448 A (Nippon Steel Corp.), Nov. 19, 1993.

* cited by examiner

*Primary Examiner*—George Wyszomierski
(74) *Attorney, Agent, or Firm*—Burns, Doane, Swecker & Mathis, L.L.P.

(57) ABSTRACT

A process for galvanizing a metal strip having a given area in a continuous galvanizing line through which the strip is run at a given speed comprising, in series, the steps of:

(iii) pre-heating the metal strip;

(iv) annealing the metal strip;

(v) cooling the metal strip;

(vi) dipping the metal strip into a bath comprising liquid zinc or a liquid zinc alloy, the steps (i)–(iv) being maintained in closed fluid contact with each other;

(vii) circulating a reducing atmosphere comprising an inert gas and hydrogen to the steps (i)–(iv) in the galvanizing line and exposing the metal strip, before the step (iv) of dipping the metal strip into the bath, to the reducing atmosphere in order to remove oxides present on its surface, (viii) replenishing the reducing atmosphere in the galvanizing line by injecting the reducing atmosphere into the line and adjusting the hydrogen flow rate depending on the area of the metal strip to be treated per unit time.

13 Claims, 2 Drawing Sheets

PROCESS FOR GALVANIZING A METAL STRIP

BACKGROUND OF THE INVENTION:

(i) Field of the Invention

The present invention relates to a process for galvanizing a metal component (strip, plate, etc.) in a continuous galvanizing line, the galvanizing line comprising, placed in series and connected to each other by ducts in order to form ducting for circulating a reducing atmosphere usually composed essentially of an inert gas, such as nitrogen or argon, and, of hydrogen, a preheat furnace, an annealing furnace, a cooling station and a station for dipping the metal component into the bath of liquid zinc or of a zinc alloy, in which process, before the metal component is dipped into the liquid bath, it is exposed to this reducing atmosphere in order to remove oxides present on the surface of the metal components.

The description which follows will refer to metal "strip" in order to be specific, and will refer indiscriminately to a bath of liquid zinc or a bath of liquid zinc alloy, without the reference chosen being regarded as restrictive, because, as is known, the industry uses alloys which are extremely varied, especially in their zinc and/or aluminum content.

In general, then, a continuous galvanizing line comprises at least four zones for treating the metal strip to be galvanized, namely a preheat zone, an annealing zone, a cooling zone and a dipping zone which comprises a zinc bath into which the metal strip to be galvanized is dipped.

(ii) Description of the Related Art

Galvanizing lines are known in which the preheat zone comprises a furnace fitted with naked-flame burners serving, on the one hand, to rapidly reheat the metal strip to be treated to a temperature typically of between 400° C. and 700° C. and, on the other hand, to make the rolling oils present on the surface of the strip undergo pyrolysis.

In order to prevent oxidation of the metal strip thus treated, the burners are operated in air depletion mode in order to provide an atmosphere which is nonoxidizing with respect to iron.

In order to be able to ensure good galvanizing, that is to say, in particular, good adhesion between coating and metal strip, it is absolutely essential to remove any surface oxide layer before the metal strip is dipped into the zinc bath. This is achieved by exposing the metal strip in the annealing furnace to a reducing atmosphere usually consisting of a mixture of nitrogen and hydrogen, the hydrogen content generally being between 15% and 40%.

For this purpose, the various treatment zones of the galvanizing line are connected together by ducts in order to form ducting for circulating the reducing atmosphere.

In order to constantly regenerate this reducing atmosphere in this ducting and thus to preserve its reducing nature, the mixture of nitrogen and hydrogen is injected into a duct also called a spout or nozzle, one end of which dips into the zinc bath and the other end is joined to the outlet end of the cooling station, so that the reducing atmosphere flows in the opposite direction to the direction in which the metal strip to be treated runs.

At the present time, for a given galvanizing line, the flow rate of the mixture of nitrogen and hydrogen and the hydrogen content of this mixture are maintained at the same level, independently of the characteristics and the run speed of the metal strip to be treated.

In practice, in order to make it possible both to treat very wide metal strips and narrow strips and to accommodate low run speeds and high speeds, the flow rate of the mixture of nitrogen and hydrogen and the hydrogen content of the mixture are fixed at a high level so as to allow the treatment even of the most unfavorable cases, i.e. metal strip of large surface dimensions and/or treated at high speeds. However, it may be imagined that this excessive quality represented by a hydrogen-rich mixture injected at a high rate entails a not insignificant cost for this reducing atmosphere. Moreover, since the atmosphere injection conditions are fixed, which the surface to be treated per unit time may vary, the production of water vapor in the enclosure, because of the reduction of the oxides, will well and truly make the reducing nature of the atmosphere vary and therefore cause variations in the quality of the final product.

SUMMARY AND OBJECTS OF THE INVENTION

The object of the invention is to provide a process making it possible to optimize the use of the reducing atmosphere for the purpose of reducing the cost that it entails in running the galvanizing line, as well as to better maintain the level of quality of the products which leave the line.

For this purpose, the subject of the invention is a process for galvanizing a metal strip in a continuous galvanizing line, the galvanizing line comprising, placed in series and connected to each other by ducts in order to form continuous ducting for circulating a reducing atmosphere which comprises an inert gas and hydrogen, a preheat furnace, an annealing furnace, a cooling station and a station for dipping the metal strip into a bath of liquid zinc or of a liquid zinc alloy, in which process, before the metal strip is dipped into the bath, it is exposed to this reducing atmosphere in order to remove oxides present on its surface, characterized in that, in order to replenish the reducing atmosphere in the ducting, the inert gas and the hydrogen are injected into it, with the hydrogen flow rate being adjusted depending on the area of the metal strip to be treated per unit time.

The process according to the invention may also include one or more of the following characteristics:

- the area of metal strip to be treated per unit time is determined from the width of the metal strip to be treated and from the speed at which the latter runs through the galvanizing line;
- the ratio of the hydrogen concentration to the water vapor concentration of the atmosphere is maintained, at least at one point in the ducting, substantially at a predefined level;
- the ratio is maintained at a predefined level at least at one point in the annealing furnace;
- the inert gas is injected at a first location into the ducting and hydrogen, or an inert-gas/hydrogen mixture, is injected at a second location a certain distance from the first location and further away from the liquid bath of the dipping station;
- the inert gas and the hydrogen, or an inert-gas/hydrogen mixture, are/is injected into the duct which connects the cooling station to said dipping station;
- the flow rate of inert gas injected into the ducting at the first location is fixed and the flow rate of hydrogen or of inert-gas/hydrogen mixture injected at second location is adjusted, depending on a set-point value of the water vapor content at a point in the annealing furnace;
- the flow rate of inert gas injected into the ducting at the first location is fixed and the flow rate of hydrogen or of the inert-gas/hydrogen mixture injected at the second location is adjusted so as to carry out the operation of maintaining, at least at one point in the annealing furnace, the ratio of the hydrogen concentration to the water vapor concentration of the atmosphere substantially at the predefined level;

the flow rate of inert gas injected into the ducting at the first location is adjusted depending on a set-point value of the water vapor content at a point in the annealing furnace;

the flow rate of inert gas injected into the ducting at the first location is adjusted so as to carry out said operation of maintaining, at least one point in the annealing furnace, the ratio of the hydrogen concentration to the water vapor concentration of the atmosphere substantially at the predefined level;

the inert gas is injected into the ducting at the first location at a substantially constant flow rate and inert gas is also injected into the annealing furnace, the flow rate of inert gas injected into the annealing furnace being adjusted depending on a set-point value of the water vapor content at a point in the annealing furnace;

the inert gas is injected into the ducting at the first location at a substantially constant flow rate and inert gas is also injected into the annealing furnace, the flow rate of inert gas injected into the annealing furnace being adjusted so as to carry out the operation of maintaining, at least at one point in the annealing furnace, the ratio of the hydrogen concentration to the water vapor concentration of the atmosphere substantially at the predefined level.

Further characteristics and advantages of the invention will emerge from the following description, given by way of nonlimiting example, with regard to the appended drawings.

DETAILED DESCRIPTION OF PREFERRED EMBODIMENTS

The present invention is also described in French Application Serial No. 98 10392, filed Aug. 13, 1998, the disclosure of which is hereby incorporated by reference.

Figure 1:
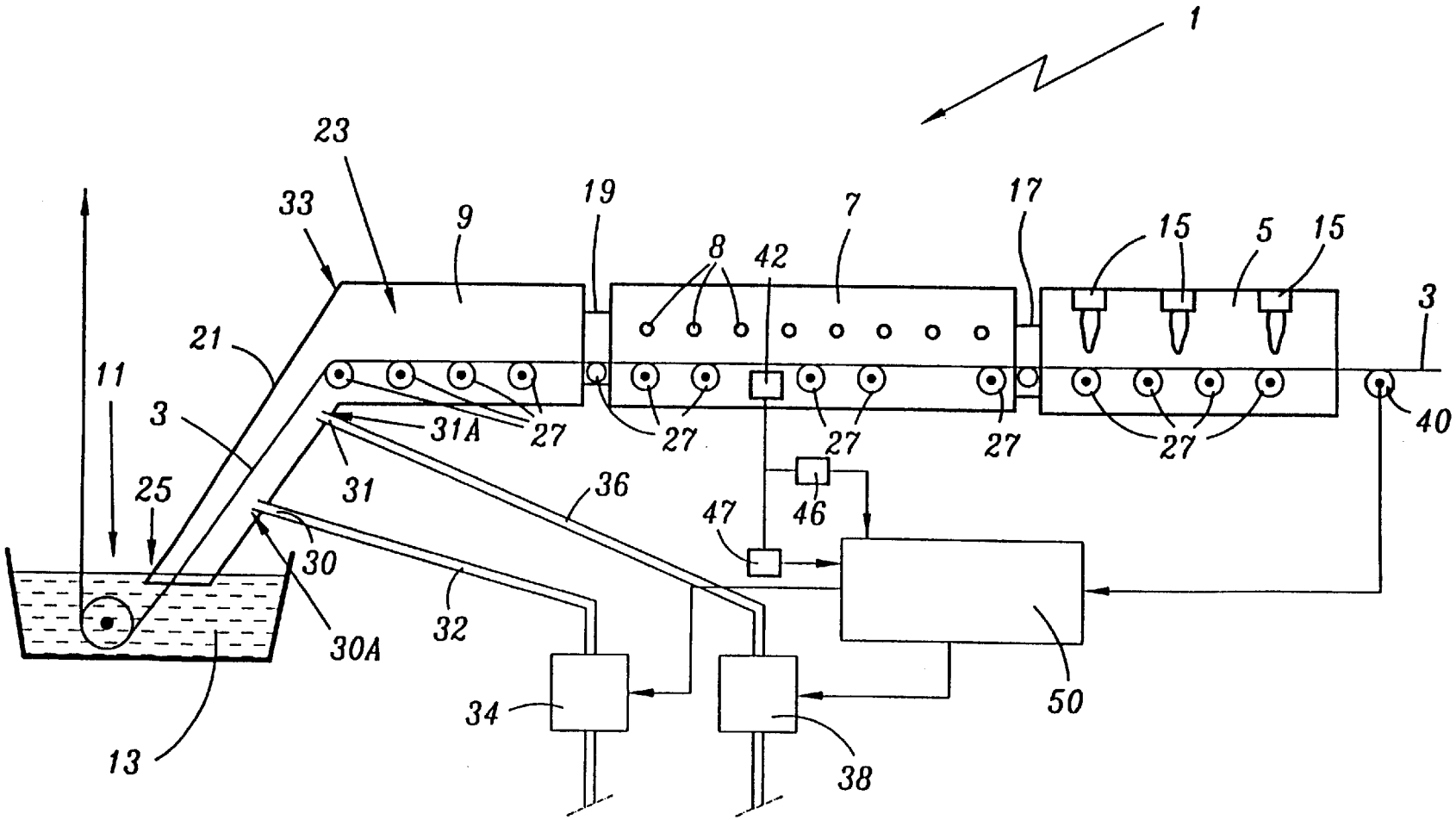
FIG. 1 is a diagrammatic representation of a continuous galvanizing line operating using a process according to the invention.

FIG. 1 shows diagrammatically a line 1 for galvanizing a metal strip 3, for example a steel strip.

The galvanizing line 1 comprises, placed in series, a preheat furnace 5, an annealing furnace 7, a cooling station 9 and a dipping station 11 which comprises a bath 13 of liquid zinc or of liquid alloy.

The preheat furnace 5 is, for example, fitted with naked-flame burners 15 serving, on the one hand, to rapidly reheat the metal strip 3 to be treated to a temperature typically of between 400° C. and 700° C. and, on the other hand, to make the rolling oils present on the surface of the strip undergo pyrolysis.

The annealing furnace 7 is, for example, fitted with electrical resistance elements or with radiant tubes, these being shown diagrammatically at 8.

The cooling station 9 serves to cool the metal strip 3, as it leaves the annealing furnace 7, to a value close to 470° C., for example.

Moreover, the preheat furnace 5, the annealing furnace 7, the cooling station 9 and the dipping station 11, each of which is in the form of a tunnel, are joined together by ducts 17, 19 and 21 in order to form, with these, a continuous ducting 23 for circulating a reducing atmosphere composed essentially of nitrogen and hydrogen.

In addition, the duct 21 joining the outlet end of the cooling station 9 to the dipping station 11 is inclined downward and its end 25 dips into the liquid bath 13. This duct 21 is often called a snout or nozzle.

Furthermore, the galvanizing line 1 according to the invention comprises, on the one hand, an injector 30 for injecting an inert gas, for example nitrogen, placed in the wall of the snout 21 at a first location 30A lying near the end 25 of the snout dipped into the liquid bath 13, above the latter, and, on the other hand, an injector 31 for injecting hydrogen (or a mixture of hydrogen and an inert gas) placed in the wall of the snout 21 at a second location 31A lying near that end 33 of the latter which is joined to the cooling station 9.

This advantageous arrangement, in which the nitrogen is injected at the first location 30A lying near the end 25 of the snout 21 dipped into the liquid bath 13, makes it possible to form, in the lower part of the snout 21, a buffer which prevents the hydrogen, injected some distance away at the location 31A, from dissolving in the bath of liquid zinc 13.

As may be seen by looking at the figure, the injector 30 is connected to a feed pipe 32 in which a flow regulator 34 is placed and the injector 31 is connected to a feed pipe 36 in which a flow regulator 38 is placed.

Furthermore, the line 1 comprises an adjustor 40 for determining and adjusting the run speed of the metal strip 3.

Moreover, a gas-sampling tap 42 inside the annealing furnace, for example in the middle of the furnace or in the last ⅓ of the furnace, makes it possible to send atmosphere samples, for analyzing, for example as shown in the figure, to an analyzer 47 which analyzes the hydrogen content of the sample and to an analyzer 46 which analyzes the water vapor content of the sample.

Of course, instead of this ex situ analysis an oxygen probe in the furnace could also, without departing from the scope of the present invention, be used, which probe delivers a voltage correlated with the $H_2/H_2O$ ratio.

The adjustor 40 and the analyzers 46 and 47 are connected to a data-processing unit 50 (for example a programmable controller), which unit is able in turn to control the operation of the two flow regulators 34 and 38.

During its treatment, the metal strip 3 guided by rollers 27 passes in succession through the preheat furnace 5, in order to be brought to a temperature here of between 400° C. and 700° C., then through the annealing furnace 7, in order to ensure it metallurgical characteristics, through the cooling station 9, in order to bring it to a temperature close to 470° C., and finally through the dipping station 11, so as to be coated with zinc.

At the same time, the unit 50 measures, as described above, the run speed of the metal strip 3, the dew point and the hydrogen content of the atmosphere, at least one point (42) in the annealing furnace 7, and, by means of the regulators 34 and 38, controls the flow rates of nitrogen and/or hydrogen injected into the snout 21, in accordance with one of the embodiments of the invention described above in the present description.

The unit 50 adjusts these nitrogen and hydrogen flow rates depending on the area of the metal strip to be treated per unit time.

Advantageously, in order to determine the area of the metal strip to be treated per unit time, the speed at which the strip runs through the line, provided by the adjustor 40, and the width of the strip 3 are taken into account.

Figure 2:
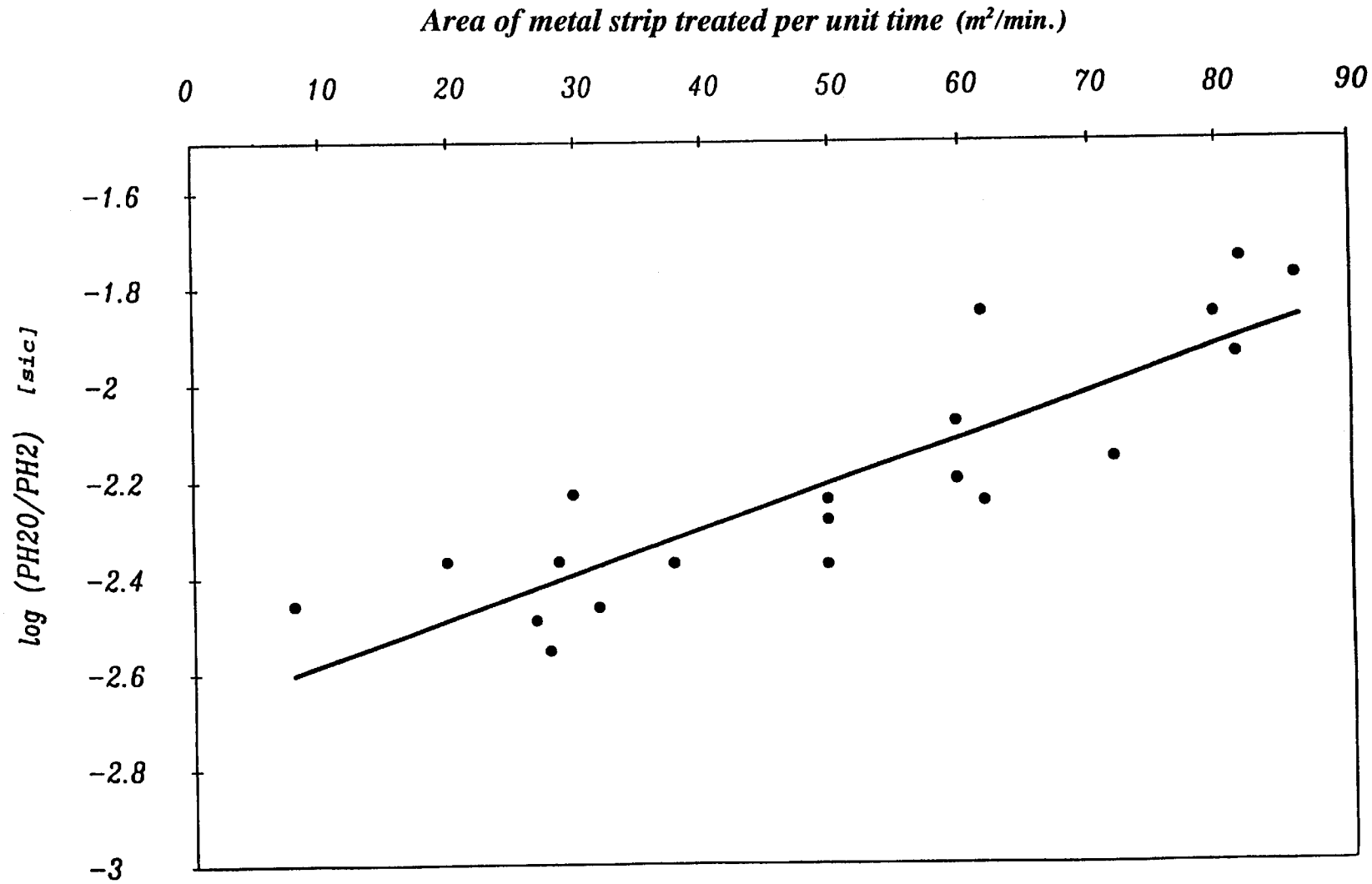
FIG. 2 shows a curve representing the variation in the logarithm of the ratio of the water content to the hydrogen content of the atmosphere at a point in the annealing furnace plotted as a function of the area of metal strip treated, for a given atmosphere setting.

In order to illustrate more clearly this notion of adjusting the flow rates depending on the area of the metal strip to be treated per unit time (which factor is evaluated by considering only one side of the strip), reference is made to the curve shown in FIG. 2, which was obtained for a given steel having application in the construction industry, under the following conditions:

injection at 30A: nitrogen of cryogenic origin, at a flow rate of 50 $Sm^3/h$; injection at 31A: cracked ammonia, at a flow rate of 70 $Sm^3/h$ (such conditions therefore give overall a mixture flow rate of 120 $Sm^3/h$, a hydrogen flow rate of 52.5 $Sm^3/h$ and a hydrogen concentration in the mixture of 43.8%);

the atmosphere sampling point (42) was located approximately 1 m from the end of the annealing furnace (taking the direction of movement of the strip into consideration);

the speed of the line was between 25 and 80 m/min., for a strip width always within the range going from 1 m to 1.20 m.

This figure therefore clearly shows the increase in the $H_2O/H_2$ ratio in the annealing furnace when the area treated per unit time (A/t) increases, a sign that water vapor production is increasing. It may therefore be seen on this curve that it is possible to define, for this galvanizing line and this average gas setting employed, two large ranges of area treated per unit time, namely a range in which A/t is less than approximately 50 $m^2/min$, and a range in which A/t lies between approximately 50 $m^2/min.$ and 90 $m^2/min.$ It therefore seems advantageous, for production conditions corresponding to the first range, to reduce the flow rate of hydrogen injected at 31 and/or the hydrogen content of the mixture, thus allowing the $H_2O/H_2$ ratio to degrade slightly while bringing the dew point of the atmosphere back to around −15° C., whereas, for production conditions corresponding to the second range, it would be advantageous to improve the dew point of the atmosphere (reduction in the $H_2O/H_2$ ratio) by increasing the flow rate of hydrogen injected at 31 and/or the hydrogen content of the mixture, and thus allow the dew point of the atmosphere to fall to about −15° to −20° C., taking the steel treated in this line into account.

It is then possible to propose, for each of the ranges, the following conditions:

for the range in which A/t is less than approximately 50 $m^2/min.$ " an $N_2/H_2$ mixture flow rate of 130 $Sm^3/h$, for a hydrogen flow rate of 27 $Sm^3/h$ and a hydrogen concentration in the mixture of 20.7%;

for the range in which A/t lies between approximately 50 $m^2/min.$ and 90 $m^2/min.$, an $N_2/H_2$ mixture flow rate of 150 $Sm^3/h$, for a hydrogen flow rate of 48.5 $Sm^3/h$ and a hydrogen concentration in the mixture of 32.3%.

Altogether this allows the hydrogen flow rate with respect to the ratio A/t to be kept constant at a value close to 0.009 $m^3$ of hydrogen per $m^2$ of strip.

FIG. 2 therefore illustrates an example of the plots that can be produced on a given line, for one or more steels treated, by adopting an average gas setting and by covering a typical range of variation of the area treated per unit time (which takes into account the line speed range normally used and the width range of products treated in the line in question), examination of these plots making it possible to determine the gas-feed setting modifications that it is advantageous to make in each case.

In the foregoing, an embodiment was described in which the flow rate of nitrogen injected by the injector 30 is maintained constant during the operation of the galvanizing line and only the hydrogen flow rate at 31 is adjusted and modified depending on the area of metal strip to be treated.

However, it may be envisaged that, depending on the case in question (improvement or degradation of the dew point of the atmosphere), it is also possible, or as a replacement, to vary the injection of inert gas at the point 30A.

According to another alternative embodiment of the process according to the invention, hydrogen zoning of the cooling zone may be created by injecting, apart from nitrogen into the ducting 23 at the first location 30A at a substantially constant flow rate and hydrogen at the location 31A, nitrogen into the annealing furnace 7, preferably in the final outlet portion of the latter. In this situation, the flow rate of nitrogen injected into the annealing furnace 7 may be adjusted depending on a set-point value of the dew point in this furnace.

This arrangement makes it possible, on the one hand, to raise the local hydrogen concentration in the cooling station 9, thus protecting the surface of the strip from oxidation before it is dipped into the zinc bath 13, and, on the other hand, to help cool the strip 3.

It may therefore be seen that, depending on the many methods of implementation, the process of the invention makes it possible not only to reduce the consumption of hydrogen, and thus the running cost for regenerating the reducing atmosphere, but also to keep the characteristics of the products, which leave the galvanizing line, constant more reliably and under economic conditions which do not entail simply establishing an excessively high quality of the atmosphere.

What is claimed is:

1. A process for galvanizing a metal strip having a given area in a continuous galvanizing line through which said strip is run at a given speed comprising, in series, the steps of:

(i) pre-heating the metal strip;

(ii) annealing the metal strip;

(iii) cooling the metal strip;

(iv) dipping the metal strip into a bath comprising liquid zinc or a liquid zinc alloy, said steps (i)–(iv) being maintained in closed fluid contact with each other;

(v) circulating a reducing atmosphere comprising an inert gas and hydrogen to the steps (i)–(iv) in said galvanizing line and exposing the metal strip, before the step (iv) of dipping the metal strip into the bath, to the reducing atmosphere in order to remove oxides present on its surface, (vi) replenishing the reducing atmosphere in said galvanizing line by injecting the reducing atmosphere into said line and controlling the hydrogen flow rate using a data processing unit as a function of the area of the metal strip to be treated per unit time.

2. The process according to claim 1, wherein said controlling comprises a step of determining the area of metal strip to be treated per unit time from the width of the metal strip to be treated and from the speed at which the metal strip runs through the galvanizing line.

3. The process according to claim 1, wherein said reducing atmosphere further comprises water vapor, the process further comprising the step of maintaining a ratio of the hydrogen concentration to the water vapor concentration in the atmosphere substantially at a specific level at least at one point in said galvanizing line.

4. The process according to claim 3, comprising maintaining said ratio at a specific level at least during said annealing step.

5. The process according to claim 1, further comprising injecting the inert gas at a first location into said galvanizing line and injecting hydrogen, or an inert-gas/hydrogen mixture, at a second location further away from the liquid bath than said first location.

6. The process according to claim 5, wherein the inert gas and the hydrogen, or the hydrogen inert-gas mixture, are/is injected into said galvanizing line between said cooling step and said dipping step.

7. The process according to claim 5 or 6, wherein said reducing atmosphere further comprises a content of water vapor, the process further comprising the steps of fixing the flow rate of inert gas injected into the galvanizing line at the first location between said cooling step and said dipping step and controlling the flow rate of hydrogen or of the mixture injected into the galvanizing line at the second location as a function of a set-point value of the water vapor content at a point in the annealing step.

8. The process according to claims 5 or 6, wherein said reducing atmosphere further comprises water vapor, the process further comprising the steps of:

(i) maintaining a ratio of the hydrogen concentration to the water vapor concentration in the atmosphere substantially at a specific level at least during said annealing step;

(ii) fixing the flow rate of inert gas injected into the galvanizing line at the first location between said cooling step and said dipping step and adjusting the flow rate of hydrogen or of the mixture injected at the second location so as to carry out said operation of maintaining, at least at one point during said annealing step, said ratio of the hydrogen concentration to the water vapor concentration of the atmosphere substantially at said specific level.

9. The process according to claims 5 or 6, wherein said reducing atmosphere further comprises water vapor, the process further comprising controlling the flow rate of inert gas injected into the galvanizing line at the first location as a function of a set-point value of the water vapor content at a point in the annealing step.

10. The process according to claims 5 or 6, wherein said reducing atmosphere further comprises water vapor, the process further comprising the steps of:

(i) maintaining a ratio of the hydrogen concentration to the water vapor concentration in the atmosphere substantially at a specific level at least during said annealing step;

(ii) adjusting the flow rate of inert gas injected into the galvanizing line at the first location between said cooling step and said dipping step so as to carry out said operation of maintaining, at least at one point during said annealing step, said ratio of the hydrogen concentration to the water vapor concentration of the atmosphere substantially at said specific level.

11. The process according to claim 6, wherein said reducing atmosphere further comprises water vapor, the process comprising injecting the inert gas into the galvanizing line at the first location between said cooling step and said dipping step at a substantially constant flow rate and also injecting the inert gas at said annealing step at a flow rate controlled as a function of a set-point value of the water vapor content at a point in said annealing step.

12. The process according to claim 6, wherein said reducing atmosphere further comprises water vapor, the process further comprising the steps of:

(i) maintaining a ratio of the hydrogen concentration to the water vapor concentration in the atmosphere substantially at a specific level at least during said annealing step;

(ii) injecting the inert gas into the galvanizing line at the first location between said cooling step and said dipping step at a substantially constant flow rate and also injecting the inert gas at the annealing step, the flow rate of inert gas injected at the annealing step being adjusted so as to carry out said operation of maintaining, at least at one point during said annealing step, said ratio of the hydrogen concentration to the water vapor concentration of the atmosphere substantially at said specific level.

13. The process according to claim 1, wherein the inert gas is nitrogen.

* * * * *